United States Patent [19]

Putnam, Jr. et al.

[11] 4,171,605

[45] Oct. 23, 1979

[54] VERTICAL FORM, FILL AND SEAL PACKAGING MACHINE WITH IMPROVED SIDE SEALING MEANS

[75] Inventors: Roger L. Putnam, Jr., East Longmeadow; Edward F. O'Brien, Northampton; James S. Groom, Wales, all of Mass.

[73] Assignee: Package Machinery Company, East Longmeadow, Mass.

[21] Appl. No.: 850,651

[22] Filed: Nov. 11, 1977

[51] Int. Cl.[2] ..... B65B 9/12

[52] U.S. Cl. ..... 53/552

[58] Field of Search ..... 53/545, 551, 552; 93/82; 156/466, 583

[56] References Cited

U.S. PATENT DOCUMENTS

| | | | |
|---|---|---|---|
| 2,660,219 | 11/1953 | Haas et al. | 93/82 X |
| 3,729,359 | 4/1973 | Monsees | 156/466 |
| 3,779,836 | 12/1973 | Henry et al. | 53/180 M |
| 4,040,237 | 8/1977 | O'Brien | 53/180 M |
| 4,043,098 | 8/1977 | Putnam et al. | 53/180 M |

*Primary Examiner*—Horace M. Culver
*Attorney, Agent, or Firm*—McCormick, Paulding & Huber

[57] ABSTRACT

A vertical form, fill and seal packaging machine has a tube former for receiving flexible packaging material in thin flat strip form and juxtaposing opposite longitudinal edge portions thereof in parallel vertically extending relationship to provide a depending tube open at the top. An end sealer provides vertically spaced horizontally extending transverse or end seals across the tube. A product dispenser discharges measured quantities of product into the tube interior through its open upper end. Tube feed means comprises first and second pairs of vertically spaced rolls respectively on opposite external sides of the tube of packaging material and first and second tube feeding belts respectively trained over said pairs of rolls. Inner runs of the belts engage the tube and have vertically extending perforate portions. Vacuum generating means communicate with the perforate portions to cause the belts to grip the tube and back-up means within the tube provide for frictional tube feeding action. Improved side sealing means comprises a third pair of rolls spaced vertically along the longitudinal edge portions and a belt trained thereover and in pressure engagement with the edge portions. Back-up means within the tube react the sealing belt pressure. The sealing means is driven in unison with the tube feed means and is both adjustable toward and away from the tube edge portions and movable bodily away from the tube edge portions to prevent overheating thereof.

18 Claims, 8 Drawing Figures

VERTICAL FORM, FILL AND SEAL PACKAGING MACHINE WITH IMPROVED SIDE SEALING MEANS

BACKGROUND OF THE INVENTION

This invention relates generally to machines for forming, filling and sealing packages from an elongated thin flat strip of flexible packaging material, the strip of material being first formed to a depending upwardly open tubular configuration, sealed longitudinally at overlapped vertically extending edge portions, sealed transversely along horizontal lines spaced vertically along the tube, and filled from above with measured quantities of product between successive transverse or end sealing operations. In advancing or drawing the packaging material downwardly through a tube former at the top of the machine, one conventional practice involves the use of end sealing jaws or bars movable in both horizontal and vertical planes. That is, the end sealing jaws are intermittently moved horizontally inwardly to engage and compress the tube and are then moved vertically downwardly to feed or draw the packaging material through the former. End sealing occurs during the feed operation. Subsequently, the end sealing jaws are moved horizontally outwardly to release the tube and are then returned vertically to their starting position.

Another known practice in advancing or feeding a strip of packaging material through a tube former involves the use of a vacuum feed belt mechanism. A pair of perforate endless belts are disposed respetively on opposite sides of the tube to engage and feed the same downwardly with gripping action provided by a reduced pressure or vacuum condition at openings in the belt. End sealing jaws in this arrangement may be stationary vertically but movable horizontally to intermittently engage, compress and transversely seal the tube between tube feed and product drop or fill operations. German Patent, Auslegeschrift No. 1,586,086, Mar. 23, 1972, discloses a vacuum belt tube feeder in a "tube type" vertical form, fill and seal packaging machine. That is, the machine includes a vertically extending tube within the tube of packaging material which serves to guide a tube of packaging material thereabout and through which measured quantities of product fall in filling the tube of material and packages formed therefrom. U.S. Pat. No. 4,043,098 entitled *VERTICAL FORM, FILL AND SEAL PACKAGING MACHINE WITH IMPROVED BACK-UP BAR FOR LONGITUDINAL SEALING,* dated Aug. 23, 1977, discloses a vacuum belt feed mechanism in a "tubeless" vertical form, fill and seal machine. In a "tubeless" arrangement, a short vertical tube may be provided within the tube former and the tube of packaging material, but the tube terminates at its lower end above the vacuum feed belts. In the region of the feed belts, belt back-up means and side sealing back-up means are provided within the tube of packaging material but are of minimal cross section viewed vertically so as not to interfere with free product fall within the tube of packaging material.

In both of the foregoing arrangements, a relatively long "product drop" is encountered. That is, the distance through which charges of product must fall from the discharge end of the product dispensing means is quite substantial. With the vertically movable end sealer arrangement the necessary vertical or tube feeding travel of the end sealing jaws results in a substantial vertical distance through which the product must fall in the filling operation. Additionally, it will be noted that the portion of the tube immediately above the end sealer is maintained in tension and may be drawn into a relatively sharp or tight "V" configuration during downward movement of the end sealer jaws. Such a tube configuration is not conducive to a good filling operation nor is resulting stress on the tube of packaging material at the end sealing jaws conducive to good end sealing operation.

In the vacuum feed belt arrangement, belt and end sealer operation can be coordinated to provide for a relaxed condition of a tube of packaging material above the end sealer, a relatively loose "V" configuration or a "U" configuration with a slight bulge being provided, and this is conducive to a good filling operation. End sealing may also be efficiently accomplished in the absence of stress on the tube of material during sealing. The inner or operative runs of the vacuum belts, however, must extend through a substantial vertical distance in order to provide sufficient belt-tube contact area for good pure vacuum gripping operation and positive tube feeding action. Thus, some improvement over an end sealer feeding arrangement may be realized but a relatively long product drop is still encountered.

A relatively long product drop distance is generally acceptable for heavy product allowed to fall freely from a product dispensing means in measured quantities into a tube of packaging material. Sucn is not the case, however, with relatively light product such as potato chips and other snack foods. With light product a condition known as product "string out" is encountered wherein air resistance may cause an upper portion of a mass of descending product to decelerate relative to the main body of the mass of product. That is, a number of potato chips at the top of a mass of falling chips may tend to "string out" vertically above the main body of the mass as it falls into the tube of packaging material. Obviously the time required for each filling operation may be significantly increased by product "string out," and this may result in turn in a severe limitation on the overall speed of operation of the machine and productioned rates will be detrimentally affected.

In addition to the foregoing, a "tubeless" type packaging machine is much to be preferred in handling light weight product such as potato chips. Jamming of product may obviously occur within the stationary tube of a "tube type" machine. In a "tubeless" machine minimal interference with product fall is achieved with minimal cross sectional area of necessary back-up means within the tube. Further, timing of machine operation may be adjusted to provide for tube feed or downward tube movement assisting at least a portion of the filling operation. That is, without a tube in the feed zone, a mass of potato chips or the like can be engaged peripherally by a downwardly moving tube of packaging material in areas between the back-up means. Thus, a much improved filling operation with lightweight material can be achieved.

From the foregoing, it will be apparent that the efficient high speed handling of potato chips and otherweight product is best accomplished in a vacuum form, fill and seal machine which is of the "tubeless" type and which provides for a minimum product drop distance.

Conventional side sealing means include intermittently operable vertical sealing bars and drag sealers adapted to seal the longitudinal tube edge portions continuously or "in transit" as the tube of material moves past the sealers. Vertical sealing bars of course operate with the tube of material stationary and with relatively long packages "double pumping" of short bars or relatively long sealing bars are required. Double pumping of short bars is inefficient and time consuming and relatively long side sealing bars dictate a relatively long product drop distance. Drag sealers accommodate a relatively short product drop distance but inhibit positive feeding action of the tube of packaging material.

It is the general object of the present invention to provide an improved side sealing means of the continuous or "in transit" type particularly well suited to but not limited to a short product drop packaging machine of the form, fill and seal type.

A further object of the invention resides in the provision of a power driven hot belt side sealer and back-up means operable as the tube of packaging material moves therepast and which assists the tube feeding action.

A still further object of the invention resides in the provision of a hot belt side sealer adjustable toward and away from edge portions of a tube of packaging material to adjust sealing pressure and the frictional feed assist and also movable bodily away from the tube to prevent overheating of the tube edge portions.

SUMMARY OF THE INVENTION

In fulfillment of the foregoing objects a form, fill and seal packaging machine is provided with improved side sealing means in the form of a pair of vertically spaced rolls adjacent the longitudinal edge portions of a tube of packaging material. A sealing belt is trained over the rolls and has a vertically extending inner run engageable with the external surface of the edge portions of the tube of packaging material. A sealing belt back-up means disposed within the tube of packaging material and in engagement with its internal surface extends vertically opposite the belt inner run whereby to react its pressure and to provide for a frictional tube feed assist with the inner belt run driven downwardly. Drive means, optionally in common with tube feed belts, rotate at least one roll in the pair of rolls to cause the inner belt run to travel downwardly in unison with tube feed belts.

Electrical heating means associated with the sealing belt maintain the latter at heat sealing temperatures and adjustment means provide for varying the pressure of the belt on the tube of material and back-up means. Selectively operable overheat withdrawal means pull the side sealer bodily away from the tube of packaging material to prevent overheating and degradation or destruction of the tube edge portions. Preferably, the vertical dimension and positioning of the sealing means is such that it does not extend substantially below the feed means or feed zone. Thus, end sealing means may be located beneath and in close proximity to the tube feed zone minimizing product drop distance.

DESCRIPTION OF THE PREFERRED EMBODIMENTS

Figure 1:
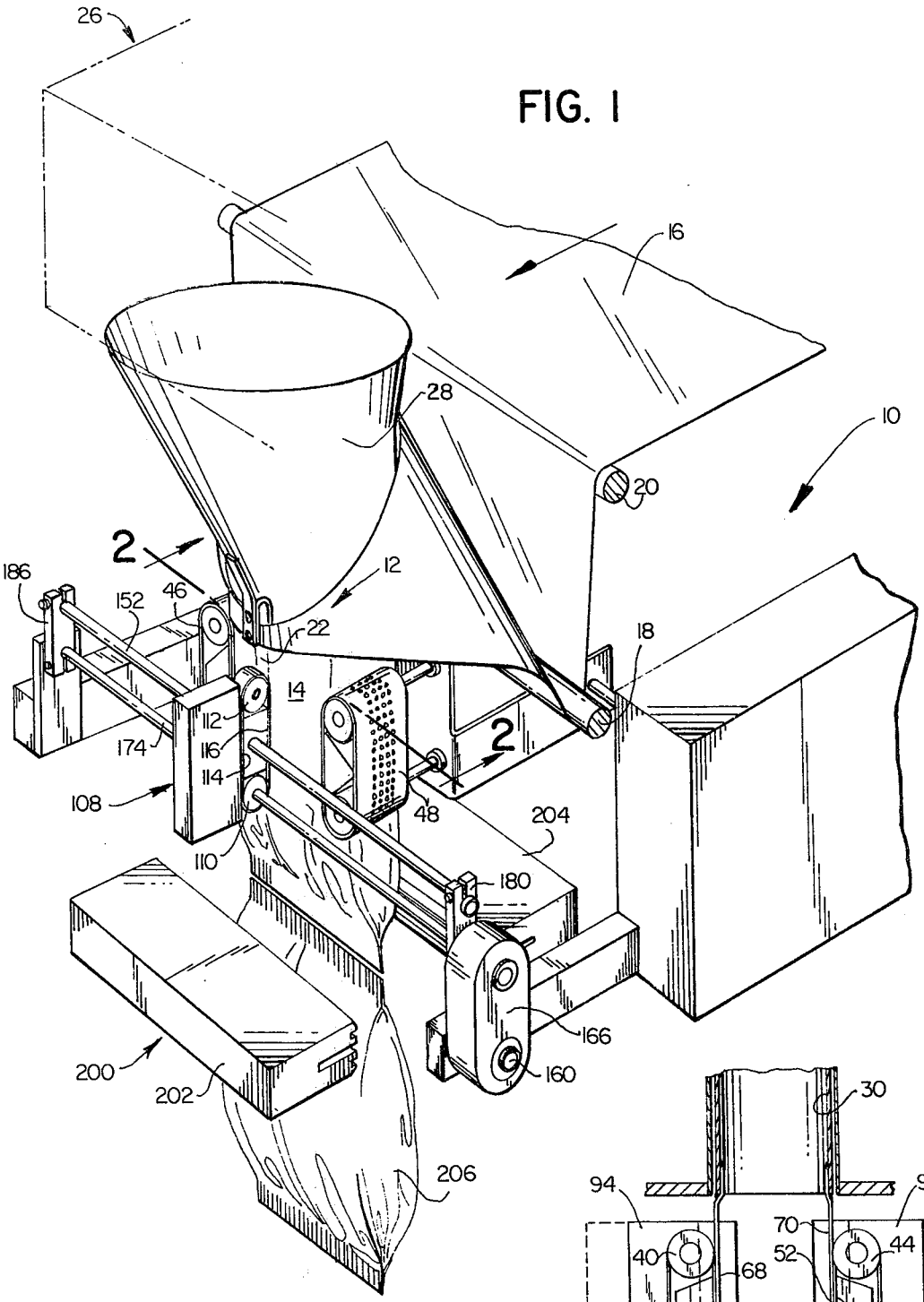
FIG. 1 is a schematic view in perspective illustrating a tubeless form, fill and seal packaging machine constructed in accordance with the present invention.
Figure 3:
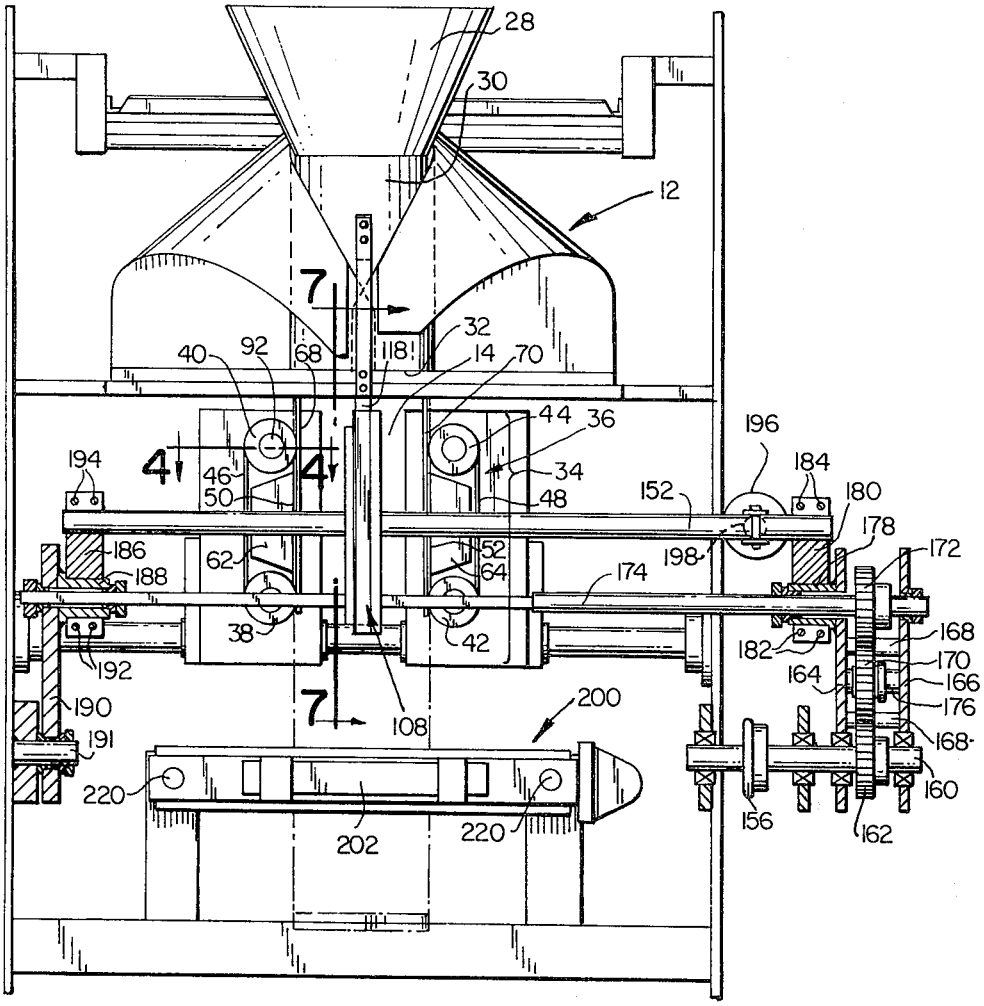
FIG. 3 is a somewhat schematic front elevational view of the packaging machine with portions thereof broken away in section to better illustrate drive means for a side sealing means located at the tube feed zone.
Figure 6:
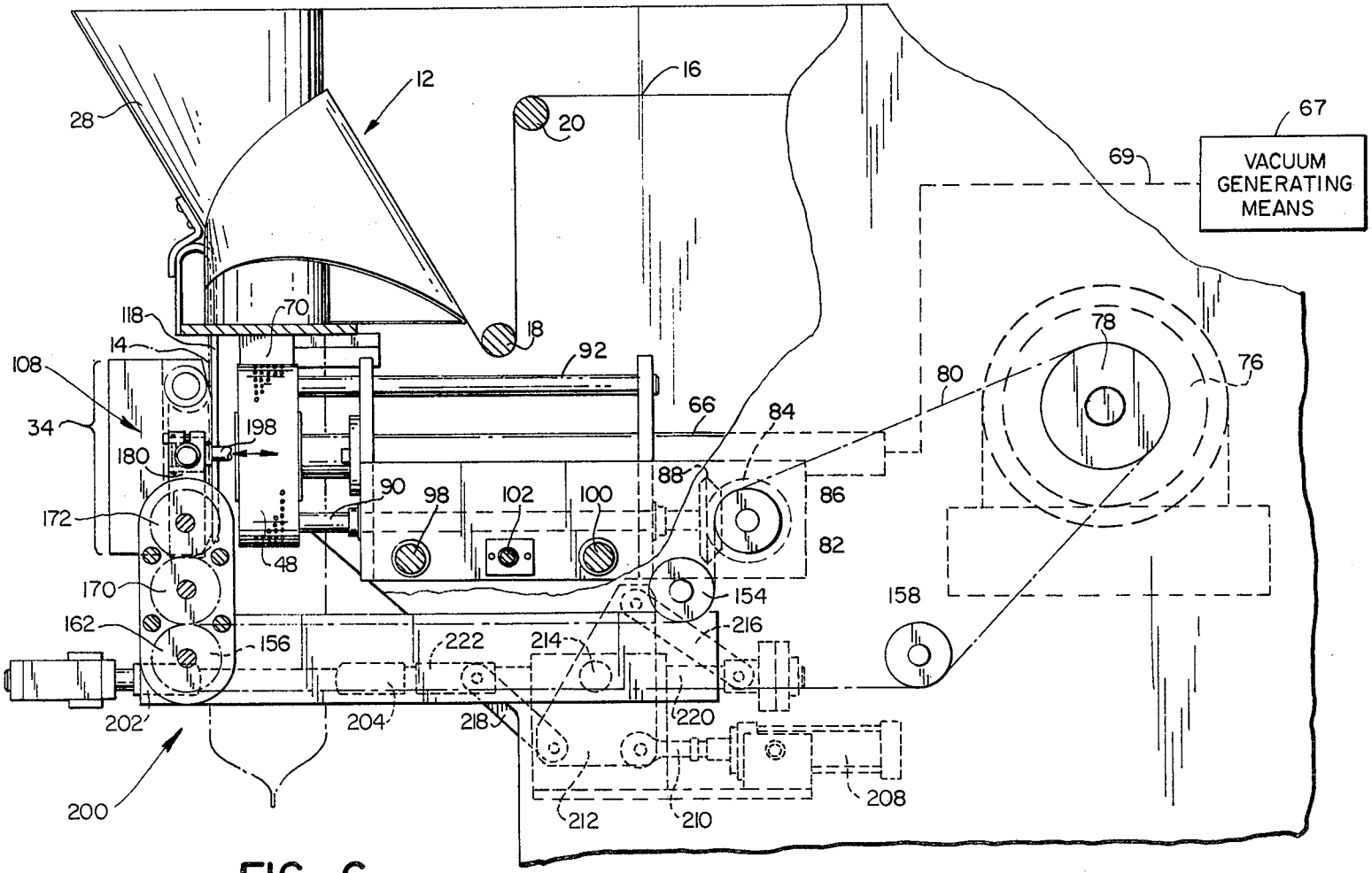
FIG. 6 is a right hand elevational view of the machine of FIGS. 1 and 3 partially broken away to illustrate drive or operating means for the tube feeder, side sealing means, and end sealing means.

Referring particularly to FIGS. 1, 3 and 6, it will be observed that a tubeless form, fill and seal packaging machine indicated generally by the reference numeral 10 includes a tube former or folder indicated generally at 12. Tube formers may be of a square or round type and the former 12 may be of one conventional type adapted to form a generally cylindrical or round tube 14 from flexible packaging material in the form of an elongated, thin, flat strip of material comprising successive package blanks as longitudinally integral contiguous sections thereof. A strip of such material is indicated at 16 in FIGS. 1 and 6 and is guided and directed in its movement from a source of supply toward the tube former 12 by guide rolls 18, 20. The source of supply, not shown, may be conventional and may take the form of a pay-off device including a storage roll from which the strip material is drawn. In passage through the former 12 the strip of material is progressively formed to the depending and upwardly open tube 14 shown with opposite longitudinal or vertical edge portions at 22 being juxtaposed by the former in overlapping and parallel vertically extending relationship. Thus, the strip of material 16 becomes a round tube in passage through the tube former, but its edge portions at 22 remain initially in an unsealed condition.

While the tube former shown is of the "round" type with the tube 14 having a generally cylindrical cross section at least initially, it should be noted that the term "tube" is used in a broad sense and is not to be construed as limited to a cylindrical tube or to any other tube of particular cross sectional configuration. Similarly, terminology denoting geometrical or spacial relationship such as "vertical," "horizontal," "depending," "beneath," etc. is employed merely for ease and convenience in description and is not to be regarded as limiting in any sense in the description and claims which follow.

A product dispensing means associated with the packaging machine is indicated generally by reference number 26 and may comprise any of a number of conventional product feeders of the volumetric, weighing or other type. Measured quantities or "charges" of product are dispensed intermittently by the dispensing means for gravity fall into the interior of the tube of packaging material 14 through its upwardly open end. As will be apparent, it is necessary to provide side and end seals to form an upwardly open tubular package for reception of the measured quantity or charges of product from the dispenser 26.

A vertically open tube or tubular product guide means is disposed beneath the product dispensing means for receiving charges of product and for directing the same downwardly to the interior of the tube of packaging material. Said means may comprise a funnel-like element 28 with a lower end portion terminating within the tube former 12 or, said means may comprise a funnel 28 as shown and an integral depending cylindrical tube 30 at a lower end portion of the funnel. The funnel and/or tube extend vertically within the tube former in radially spaced relationship therewith and within the tube of packaging material in the former but in any event the lower end portion of the hopper 28 and/or tube 30 terminate above a tube feed zone in a packaging machine of the "tubeless" type. The tube 30 shown serves both to direct and guide charges of product and to guide the packaging material thereabout and its lower end portion terminates as shown at 32 above a tube feed zone 34 therebeneath.

Tube feed means at the feed zone 34 may vary but as shown comprise first and second pairs of vertically spaced rolls respectively on opposite external sides of the tube of packaging material 14. The tube feed means is indicated generally at 36 and comprises a first or left hand pair of lower and upper rolls 38, 40, FIGS. 2 and 3. The rolls 38, 40 are spaced vertically along the path of movement of the tube 14 and lower roll 38 is driven with upper roll 40 free running. A second or right hand pair of rolls in FIGS. 2 and 3 comprises driven lower roll 42 and free running upper roll 44. First and second endless feed belts 46, 48 are respectively trained over the first and second pairs of rolls 38, 40 and 42, 44 and each belt has a vertically extending inner run engageable with the external surface of the tube of packaging material 14. Inner run 50 of belt 46 and inner run 52 of belt 48 are so illustrated in FIGS. 2 and 3.

Figure 4:
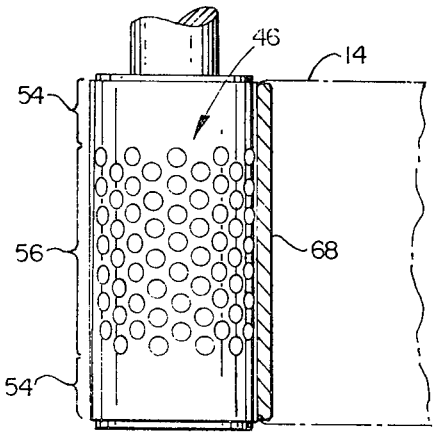
FIG. 4 is an enlarged fragmentary horizontal section taken generally as indicated at 4—4 in FIG. 3 and showing a left hand feed roll, feed belt, an associated tube guide and back-up member, and a portion of a tube of packaging material.
Figure 5:
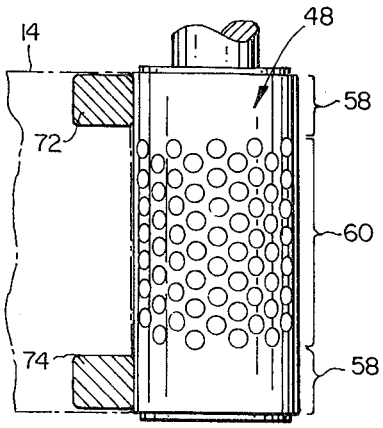
FIG. 5 is an enlarged fragmentary view similar to FIG. 4 but shows a right hand feed roll, feed belt, and a back-up means at an opposite side of a tube of packaging material, the back-up means taking an alternative form with a pair of spaced back-up members opposing imperforate marginal belt portions.

As best illustrated in FIGS. 4 and 5, the feed belts 46 and 48 each have vertically extending opposite marginal portions which are imperforate and an intermediate portion which is perforate. The belt 46 is shown in FIG. 4 with imperforate opposite marginal portions 54, 54 and a perforate intermediate portion 56 while the belt 48 in FIG. 5 has imperforate marginal portions 58, 58 and intermediate perforate portion 60. Vacuum generating means communicate with at least the intermediate perforate portions of the belts along their inner runs 50, 52 whereby to cause the belt runs to grip the tube of packaging material for downward feeding or advancement thereof on downward movement of the belt runs. As shown, the belt 46 has an associated vacuum box 62, FIGS. 2 and 3, and the belt 48 has a similar vacuum box 64 associated therewith, the said vacuum boxes being disposed between inner and outer belt runs. The vacuum boxes 62, 64 in turn communicate with a vacuum tube 66 best illustrated in FIG. 6 and which extends rearwardly in the packaging machine for communication with a conventional vacuum generating means 67 via broken line 69.

In order to provide for combined vacuum-friction feeding action of the tube feed means, a tube guide and belt back-up means is disposed within the tube of packaging material 24 in engagement with its internal surface and said means extends vertically opposite at least each imperforate marginal portion of each belt inner run to prevent lateral vacuum loss and to provide for frictional tube feeding action. That is, a slight pressure engagement of the vacuum belt inner runs with the tube of packaging material is established and reacted by the tube guide and belt back-up means. A vacuum sealing effect is thus achieved between the tube of packaging material and the imperforate marginal belt portions 54, 54 and 58, 58 whereby to prevent lateral vacuum loss from the laterial ingress of ambient air between the belts and the packaging material. Thus, positive gripping action of the tube of material and vacuum feeding is enhanced. Further, the desired frictional feeding action is provided to assist the vacuum feeding action of the belt inner runs.

Figure 2:
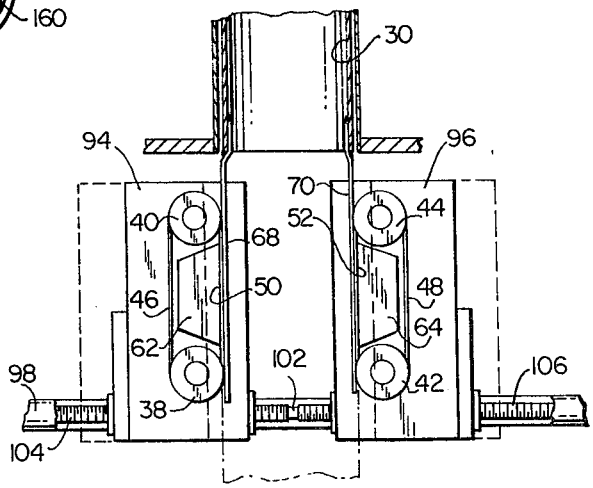
FIG. 2 is a somewhat schematic and fragmentary vertical section taken through a tube feed zone as indicated generally at 2—2 in FIG. 1.

Tube guide and belt back-up means shown comprise first and second elongated vertically extending thin flat members 68, 70 shown in FIGS. 2 and 3 respectively disposed in opposing relationship with the inner runs 50, 52 of the feed belts 46, 48. First or left hand back-up member 68 is better illustrated in section in FIG. 4 and it will be observed that its width is approximately equal to the width of the belt 46 so as to provide frictional belt feeding action throughout the width of the belt. Back-up member 70 is identical in construction and in its cooperation with the belt 48. As best illustrated in FIG. 2, the back-up members 68, 70 are secured at upper end portions to the tube 30 of the tubular product guide means and depend therefrom in cantilever relationship within the tube of packaging material. The back-up members have at least minimal spring characteristics so as to resiliently back up their respective tube feeding belts and to assist in the necessary slight pressure engagement between the belts and the tube of packaging material.

Referring now to FIG. 5, an alternative tube guide and back-up means comprises first and second pairs of elongated vertically extending flat faced members disposed internally of the tube of packaging material and respectively in opposing relationship with the opposite marginal portions of the first and second feed belts. A second or right hand pair of back-up members is illustrated in FIG. 5 at 72, 74 in operation association with the belt 48 and, more particularly, the opposite imperforate marginal portions 58, 58 of the belt. As illustrated, the width of the right hand or flat faces of the member 72, 74 is approximately equal to the width of the imperforate belt portions 58, 58. The members 72, 74 and their counterparts in a left hand pair adjacent a left hand feed belt may be arranged in depending cantilever fashion with upper ends secured to a tube such as the aforementioned tube 30.

Comparing FIGS. 4 and 5 it will be observed that the member 68 has the advantage of maximum frictional feeding action in its engagement throughout the width of the belt 46 whereas a slightly less efficient frictional feed results with the back-up members 72, 74, frictional feed occurring only at the opposite marginal belt portion 58, 58. Conversely, the free area of the tube of packaging material 14 exposed to potato chips or other lightweight product and moving downwardly to inhibit jamming of the product is somewhat greater in the FIG. 5 arrangement than in the FIG. 4 arrangement.

The width of the imperforate marginal belt portions 54, 54 and 58, 58 may vary but it is believed that each such portion should comprise at least 10 percent of total belt width. As illustrated, each marginal portion 54, 58 comprises approximately 20 to 25 percent of total width of its belt and excellent results are achieved. That is, vacuum sealing action is highly effective with the ingress of ambient air between belt marginal portions and the tube 14 minimized and positive frictional feeding action is achieved. With the FIG. 4 arrangement, frictional feed also results at the perforate belt portion 56 and it is believed that this belt portion should have open vacuum area in the range 20 to 60 percent of the total area of the belt portion. As illustrated, the intermediate belt portion 56 is approximately 40 percent open or vacuum area and excellent results have been obtained.

Belt material may also vary but should have high friction characteristics for efficient frictional feeding action. A rubber-like material is preferred and at present a silicone rubber is employed. The back-up means, on the other hand, should have a low friction surface for free sliding engagement with the internal surface of the tube of packaging material 14. A fiberglass facing covered with a fluorocarbon polymer is presently preferred and a Teflon covering employed.

The manner in which the lower feed rolls 38, 42 are driven may vary widely and an illustrative example is shown schematically in FIG. 6. A motor, variable speed drive, and clutchbrake mechanism is illustrated at 76 with an output sprocket 78 driving a chain 80 extending to a drive sprocket 82 for a bevel gear 84. The bevel gear 84 is mounted on a shaft 86 which carries a similar bevel gear at an opposite side of the machine, not shown. The bevel gear 84 drives the lower roll 42 and the opposite bevel gear drives the roll 38 in unison therewith and in the appropriate direction for downward movement of inner belt runs 50, 52. A bevel gear 88 is driven by the bevel gear 84 to rotate a shaft 90 which in turn supports and drives the roll 42. A similar arrangement is provided at the opposite side of the machine for the roll 38. Upper roll 44 is free running and supported on a shaft 92 in FIG. 6, a similar shaft being provided for the roll 40 at 92, FIG. 3.

Referring now particularly to FIG. 2 it will be observed that first and second support means are provided respectively for the feed rolls and belts of the tube feed means 36. A support means 94 for the first or left hand pair of feed rolls 38, 40 journals the aforementioned roll carrying shafts and a support means 96 for the right hand rolls 42, 44 is similarly constructed and arranged. The support means 94, 96 are slidably mounted on cross bars 98, 100, FIG. 6, so as to provide for horizontal movement of the support means and the left and right hand roll and belt assemblies toward and away from a tube of packaging material 14. Thus, horizontal adjustment may be accomplished for varying the pressure exerted by the feed belts 46, 48 on the tube of material and reacted by the associated back-up means 68, 70. Frictional tube feeding action is thus manually adjustable. Preferably, adjustment of the support means 94, 96 and the roll and belt assemblies is accomplished in unison and in opposite directions as required by means of an elongated screw means 102, FIGS. 2–6, which is threadably engaged with each of the support means and which has oppositely threaded portions 104, 106. On rotating the screw means or screw 102 to the desired position of adjustment, provision may of course be made for locking the support means 94, 96 and the roll and belt assemblies in position.

With the belt pressure on the tube 14 properly adjusted for the desired frictional feed, it will be apparent that the belts can be driven intermittently as required for tube feed operations in timed relationship with sealing and filling operations. The clutch-brake mechanism in the drive assembly 76 can be energized and de-energized as required by appropriate electrical control means whereby to drive the above described power train and the roll and belt assemblies. Co-pending application Ser. No. 846,820 entitled *IMPROVED CONTROL SYSTEM FOR PACKAGE MAKING MACHINE,* Charles J. Simmons, filed on Oct. 31, 1977 illustrates and describes a suitable electrical control system for this purpose.

The improved side sealing means for sealing the depending longitudinal edges of the tube of packaging material 14 is indicated generally at 108 in FIGS. 1, 3 and 6 and is of the continuous or "in transit" type adapted to seal the longitudinal tube edges at 22 as the tube of material 14 is drawn downwardly through the former by the tube feed means 36. Preferably and as shown, the side sealer 108 is disposed between the tube feeding rolls and belts with the latter arranged on opposite external sides of the tube of packaging material and with the longitudinal edge portions of the tube displaced approximately 90° from each of the pairs of tube feeding rolls and belts. Further, the position and vertical dimension of the side sealer 108 is such that its lower end does not extend substantially below the feed rolls and belts and thus permits the location of an end sealing means closely therebeneath with resulting minimization of product drop.

The side sealer 108 is of the hot belt type and includes a third vertically spaced pair of rolls with a lower driven roll shown at 110 and an upper free running roll at 12. The rolls 110, 112 have an endless sealing belt 114 trained thereover with an inner run 116 extending vertically and engageable with the longitudinally extending tube edge portions at 22. Extending internally of the tube 14 is a sealing back-up member 118 which engages the longitudinal tube edges and serves to react the pressure of the sealing belt 114. The back-up member is preferably secured at an upper end portion to the funnel 28 as illustrated so as to depend in cantilever relationship and to resiliently back up the sealing belt. In accordance with the free product fall and tube engagement requirements of a tubeless machine, the member 118 is constructed with a minimal cross section viewed vertically and is preferably provided with a low friction surface for sliding engagement of the tube 14 thereover. A fluorocarbon polymer is preferred and, more specifically, a Teflon cover layer on a sponge-like fiberglass tape underlayer is presently employed. As will be seen, the tape may also serve a heat insulating function to prevent excessive heat loss to the relatively cold back-up member 118 from the hot belt 114 of the sealer.

The hot belt 114 is preferably also adapted for friction tube feeding action as mentioned and, accordingly, may be provided with a high friction surface. A heat resistant rubber-like material is preferred and a silicone rubber is presently employed with heat resistance to approximately 550° F. The reverse side of the belt may be of a two ply monofilament polyester for engagement with the rolls 110, 114.

At this point a comparison should be made between the hot belt side sealer 108 and prior art drag sealers and long bar sealers. As stated, drag type sealers tend to inhibit downward tube feed movement rather than to provide a frictional feed assist. Long bar sealers, on the other hand, operate intermittently to engage and seal the longitudinal edges of a tube of packaging material and while they may not inhibit tube feeding operation, they do, however, create a necessary long product drop condition especially in the case of relatively long packages.

In the above-mentioned pure vacuum feeding arrangement, U.S. Pat. No. 4,043,098, good tube feeding action is obtained with belt feed rolls arranged on 12 inch centers and with the belts drawing the tube of material through a stationary drag sealer. With the present vacuum-friction feed and with the hot belt sealer assisting tube feeding action, all belt rolls are arranged approximately on six inch centers, roll axes spaced apart six inches vertically, and excellent tube feeding and side sealing has been obtained. Thus, a 50 percent reduction in the length of the feed zone has been achieved and the salutory effect on product drop distance will be self evident.

Figure 7:
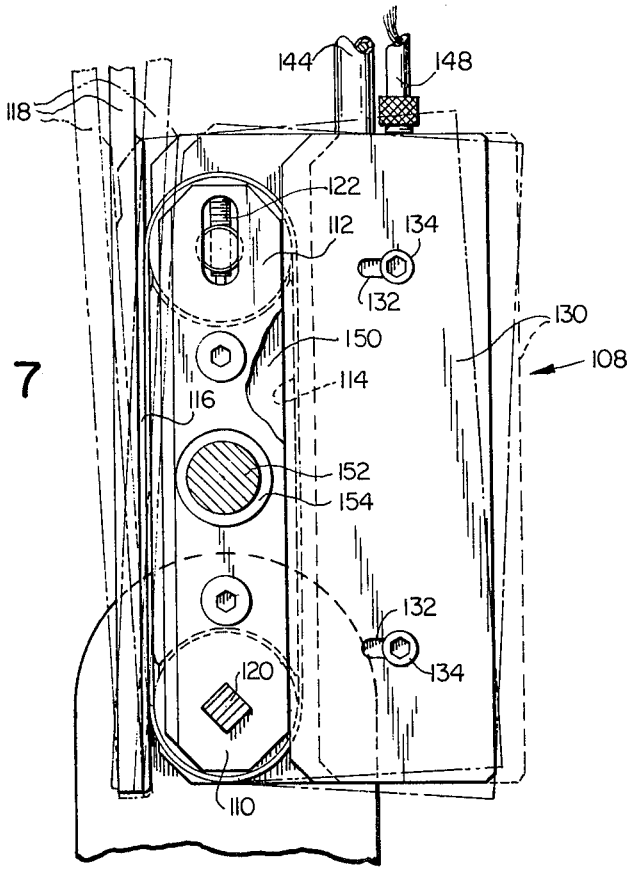
FIG. 7 is an enlarged fragmentary view taken generally as indicated at 7—7 in FIG. 3 and showing a side sealing means.
Figure 8:
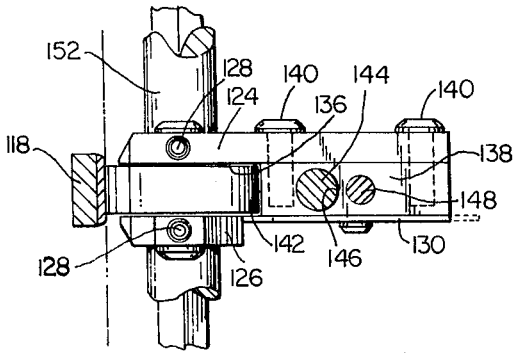
FIG. 8 is a top view of the side sealing means of FIG. 7.

Referring particularly to FIGS. 7 and 8, the presently preferred detailed construction of the hot belt side sealer 108 will be better understood. Driven roll 110 is mounted on a rectangular shaft 120 which extends horizontally in the packaging machine and free running roll 112 has a short stub shaft 122 journalled in a housing comprising spaced vertically extending plates 124, 126, FIG. 8. The plates 124, 126 are slotted vertically to provide for adjustment of the stub shaft 122 by means of adjustment screws 128, 128. Thus, the belt 114 may be trained over the rolls 110, 112 and the roll 112 adjusted vertically for proper belt tensioning. In introducing the belt 114 to the rolls 110, 112, the belt may be moved axially thereover from a lower axial position in FIG. 8 with a belt retaining plate 130 displaced rightwardly in FIGS. 7 and 8 to accommodate such belt entry. Horizontal slots 132, 132 in the plate 130 cooperate with small binder screws 134, 134 to allow the plate 130 to be moved rightwardly for belt entry and thereafter moved leftwardly and secured in position for belt retention. When in position on the rolls 110, 112, the belt 114 resides in a belt channel 136 defined between the plates 124, 126, FIG. 8.

Heating means for the belt 114 preferably take the form of a heat block 138 secured to the housing plate 124 by suitable screws 140, 140 and disposed between said plate and the plate 30. The heat block 138 has good heat conduction characteristics, as for example a steel block, and has a vertically extending inner surface 142 which engages a rear or outer run of the belt 114 in heat transfer relationship therewith. A heating element, preferably electrical, 144 is entered in a suitable vertical opening 146 in the heat block 138 and a heat sensing element 148 is disposed adjacent thereto. Conventional electrical power supply and control means, not shown, are connected with heating element 144 and heat sensor 148 to maintain the heat block 138 at the desired temperature for effecient sealing by the belt inner run 116 at the longitudinal tube edges. A temperature in the neighborhood of 200° F. is presently employed for the heat block 138.

Disposed between the inner and outer runs of the belt 114 and best illustrated at broken away portion, FIG. 7, is a heat bar 150. The bar 150 is secured in position between the plates 124, 126 and has inner and outer surfaces which extend vertically and which respectively engage the inner and outer belt runs. The bar 150 should be of a good heat conductor and steel is presently employed.

In operation of the side sealer, the heat block 138 the heat bar 150, and the sealing belt 114 are maintained at desired heat sealing temperature as indicated and preferably insulation is provided at least about the rear portion of the sealer and around the plate 124, the heat block 138 and the plate 130. Further, a rod 152 forming part of a sealer support means extends through the plates 124, 126 and the heat bar 150 and a heat insulating bushing 154 is preferably provided about the rod. Heat loss to the rod 152 is thus minimized, a bushing 154 of ceramic material being presently employed. Still further, the sealing back-up bar or member 118 may be provided with a source of heat to prevent excessive heat loss thereto through the longitudinal edges of the tube of packaging material. At the present time, however, insulation of the back-up bar is deemed sufficient.

The hot belt sealer 108 is preferably driven in unison with the tube feeder 36 and as best illustrated in FIG. 6, the aforementioned chain 80 in the tube feeder power train extends from the sprocket 82 to an idler sprocket 154. From the sprocket 154 the chain extends forwardly in the machine to drive a sprocket 165, FIGS. 3 and 6. From the sprocket 156 the chain extends to a second idler sprocket 158 and returns to the main drive sprocket 78 associated with the motor, variable speed drive, and clutch-brake mechanism 76.

As best illustrated in FIG. 3, the sprocket 156 is mounted on a short shaft 160 which also carries a first or lowermost gear 162 in a bodily movable three gear power transmitting train mounted between plates 164 and 166. The gear mounting means or plates 164 and 166 are secured together by short tie rods 168, 168. A second or intermediate gear 170 in the train drives an uppermost or third gear 172 mounted on a cylindrical extension 174 of the rectangular drive shaft 120 for the lower sealing belt roll 110. Each of the shafts 160 and 174 is journalled in the plates 164, 166 and intermediate gear 170 has a short stub shaft 176 also journalled in the plates 164, 166.

Still referring to FIG. 3, the plate 164 has a short cylindrical housing or annular boss 178 through which the shaft 174 extends and about which a lower end portion of a pivot member or bar 180 is secured. That is, the pivot bar 180 has a split lower end portion with a pair of binder screws 182, 182 and the bar may thus be secured in position about the boss 178 at selected angles of inclination from the vertical. The bar 180 forms a further part of a support means for the side sealer and is swingably adjustable about an axis coincident with the axis of the shaft 174. At an upper end portion the pivot member or bar 180 also has a bifurcated or split configuration and is provided with a pair of binder screws 184, 184. The split upper end portion of the pivot bar receives a right hand end portion of the support or mounting rod 152 for the heat sealer 108 and is adjustable with respect thereto on suitable manipulation of the binder screws.

At a left hand side of the machine in FIG. 3 and at an opposite end portion of the support rod 152, a second pivot bar 186 is provided and may be identical in all respects with the pivot bar 180. A split upper end portion thereof adjustably receives the support or mounting rod 152 and a split lower end portion thereof receives a cylindrical extension or annular boss 188 on a plate 190. The boss 188 is concentric with and receives a left hand end portion of the drive shaft 120 for the lower roll 110 of the side sealer. Binder screws 192, 192 are associated with split lower end portion of the pivot bar 186 and binder screws 194, 194 are provided at an upper end portion thereof.

From the foregoing, it will be apparent that the side sealer 108 can be readily adjusted toward and away from the longitudinal edge portions of a tube of packaging material 14 and its back-up member 118. Such adjustment is illustrated in somewhat exaggerated form by broken line positions of the side sealer and the back-up member 118 in FIG. 7. Both efficient side sealing and the desired frictional tube feeding assist are insured with proper adjustment of the side sealer and its support means. In effecting such adjustment, binder screws at the lower and/or upper ends of the pivot bars 180, 186 are first loosened, the pivot bars are then swung arcuately as necessary to provide for the desired pressure engagement of the inner belt run 116 with the tube edges and back-up member 118. The binder screws are then re-tightened to secure the pivot bars and the side sealer 108 in position. Thereafter, the side sealer belt 114 is operated in unison with the tube feeder 36 by the aforementioned drive means.

It may also be desirable or necessary to bodily move the side sealer 108 completely away from the longitudinal edge portions of the tube 14 as for example on termination of packaging machine operation for a significant period of time. Deterioration or destruction of the packaging material from an overheating condition might otherwise occur. In accomplishing side sealer withdrawal, a presently preferred practice involves the provision of a selectively operable fluid cylinder 196 mounted on the machine frame as illustrated in FIG. 3. The cylinder has a reciprocable rod 198 shown in broken line in FIG. 3 and partially illustrated in FIG. 6. A forward end portion of the rod is secured to the mounting rod 152 for the side sealer for movement of the rod on actuation of the fluid cylinder. When it is desired to withdraw the side sealer from engagement with the tube of packaging material, the rod 198 is moved leftwardly in FIG. 6 whereupon the entire assembly comprising the rod, side sealer 108, the gears 162, 170 and 172 and the mounting plates 164, 166 are swung arcuately in a counterclockwise direction about the axis of shaft 160. At a left hand side of the machine in FIG. 3 a similar mounting means comprises the plate 190 swingable about stub shaft 191 coaxial with shaft 160. Slight displacement of the gear 170 relative to the gear 162 may occur during such swinging movement but has no detrimental effect. On resumption of machine operation or a ready condition, the fluid cylinder 196 may be actuated to move the rod 198 rightwardly in FIG. 6 and return the side sealer 108 to its operative position as illustrated.

End sealing means in the packaging machine of the present invention is preferably of the vertically stationary type as indicated above and appears schematically in FIG. 1 and in somewhat more detail in FIGS. 3 and 6. The reference numeral 200 is used to indicate the end sealing means generally and said means may be of a conventional type illustrated and described more fully in U.S. Pat. No. 4,040,237 entitled *SEALING JAW MECHANISM FOR PACKAGE MAKING MACHINE,* Edward F. O'Brien, issued on Aug. 9, 1977. A pair of sealing bars or jaws is provided as indicated at 202, 204 and the jaws or bars are adapted to be moved toward each other in unison to compress and seal a tube of packaging material transversely. Electrical or mechanical cut-off means may also be included in the jaws 202, 204 to sever a completed package of material such as the package 206 in FIG. 1. The jaws are operated intermittently in timed relationship with the tube feeder and side sealer but their operating means is independent of the drive means for the tube feeder and side sealer so as to accommodate independent timing adjustment and to form packages or bags 206 of varying length. That is, a relatively short tube feeding and side sealing operation may be provided followed by a timed end sealing operation for relatively short bags and a relatively long tube feeding and side sealing operation followed by a timed end sealing operation for longer bags. The packaging machine of the present invention may be adjusted in its timed operation to provide bags ranging from four to five inches in length to eighteen to twenty inches in length. Further description and illustration in this regard appears in the aforementioned co-pending application Ser. No. 846,820 entitled *IMPROVED CONTROL SYSTEM FOR PACKAGE MAKING MACHINE,* Charles J. Simmons, filed on Oct. 31, 1977.

The independent drive or operating means for the end sealer 200 preferably comprises a selectively operable fluid cylinder 208 shown in broken line form in FIG. 6. The cylinder 208 is electrically controlled and has an output rod 210 extending to a toggle member 212. The toggle member 212 swings about a pivot point 214 and has a rear toggle link 216 and a front toggle link 218. The rear toggle link 216 is attached to rod or rods 220 which extends forwardly in the machine to the front sealing jaw 202. The rear sealing jaw 204 is driven by a slide member 222 in turn driven by the front toggle link 218.

It will be apparent that left hand or forward movement of the cylinder rod 210 will pivot the toggle member 212 in a clockwise direction about its pivot point 214 whereby to cause the toggle link 216 to urge the rod or rods 220 rightwardly or rearwardly in the machine and to draw the jaw 202 rearwardly and into engagement with a tube of packaging material. Simultaneously the toggle link 214 urges the slide member 222 and the jaw 204 forwardly or in a left hand direction to cooperatively engage, compress, and seal the tube of packaging material. Release of the tube of packaging material by the jaws 202, 204 is of course accomplished on a return stroke of the rod 210 and operation of the aforesaid elements in an opposite direction.

The elements shown in broken line in FIG. 6 may of course be duplicated at an opposite side of the machine and at an opposite end of the sealing jaws 202, 204.

From the foregoing it will be apparent that the improved packaging machine of the present invention embodies a judicious combination of all features desirable in the efficient handling of lightweight product in high speed packaging machine operation. The tubeless construction of the machine together with its short feed and side sealing zone and resulting short product drop characteristics provides for substantial improvement in product handling and speed of operation. Machine speed is substantially enhanced and it is believed that more than a 100 percent improvement in production rates can be achieved. Whereas prior machines have operated in the range of 30 to 40 packages or bags per minute, the present machine has been successfully operated in the range of 90 to 100 packages per minute.

We claim:

1. A vertical form, fill and seal packaging machine comprising a source of flexible packaging material in the form of an elongated thin flat strip of material of uniform width comprising successive flat package blanks as integral longitudinally contiguous sections thereof, a tube former adapted to receive said strip material and to progressively form the same to a depending and upwardly open tubular configuration, opposite longitudinal edge portions of the material being progressively juxtaposed by said former so as to extend vertically in parallel relationship for side sealing, product dispensing means above said former and operable for the gravity discharge of measured quantities of product to the interior of the tube of packaging material through its said upwardly open end, end sealing means operable to provide successive longitudinally spaced horizontal end seals across the tube, first and second pairs of vertically spaced rolls respectively on opposite external sides of said tube of packaging material beneath said tube former, first and second endless tube feeding belts respectively trained over said first and second pairs of rolls, each belt having a vertically extending inner run engageable with the external surface of the tube of packaging material, means for driving at least one roll in each of said first and second pairs of rolls to cause said inner belt runs to travel downwardly in unison and thereby to effect tube feeding action drawing the tube of material downwardly through the former and successively presenting said integral packaging blanks therebeneath for filling, sealing and package formation, and side sealing means for engaging and sealing together said juxtaposed vertically extending longitudinal edge portions of said depending tube of packaging material, said means comprising a third pair of rolls spaced vertically along the path of tube movement adjacent the tube longitudinal edge portions, at least one of said third pair of rolls being driven in unison with said tube feeding rolls by said drive means for said tube feeding rolls, a third endless belt trained thereover and having an inner run in external pressure engagement with the longitudinal tube edge portions and movable downwardly therewith during said tube feeding action, vertically extending sealing backup means disposed within the tube of packaging material adjacent said longitudinal edge portions and internally engaging the same to react the pressure of said inner run of said sealing belt, electrical sealing belt heating means engageable with the belt and operable to heat the same whereby to heat seal said longitudinal edge portions together in downward movement of the tube of packaging material past the side sealing means, and a support means for said side sealing means to move said sealing means toward and away from said longitudinal edge portions of the tube of packaging material for adjustment of pressure engagement of said inner sealing belt run with said tube edge portions and back-up means, said support means comprising at least one pivot member having one end portion swingably adjustable about the axis of said driven sealing belt roll, and said member having an opposite end portion connected with said side sealing means whereby to arcuately move the same toward and away from the longitudinal tube edge portions as aforesaid.

2. A vertical form, fill and seal packaging machine as set forth in claim 1 wherein said first and second pairs of tube feeding rolls and their belts are arranged on opposite external sides of said tube of packaging material with the longitudinal edge portions of the tube displaced approximately 90° from each of said pairs of rolls and belts, and wherein the position and vertical dimension of said side sealing means are such that its lower end does not extend substantially below said tube feeding rolls and belts thus permitting location of said end sealing means closely therebeneath and minimizing the vertical distance through which the quantities of product must fall.

3. A vertical form, fill and seal packaging machine as set forth in claim 1 wherein said end sealing means comprises a pair of opposing sealing jaws beneath said tube feeding rolls and belts and side sealing means and movable horizontally in unison toward and away from said tube of packaging material respectively to engage and end seal the tube and to free the tube.

4. A vertical form, fill and seal packaging machine as set forth in claim 3 wherein said end sealing jaws are adapted for operation independently of but in timed relationship with said tube feeding belts whereby to form packages of varying length from said tube of packaging material.

5. A vertical form, fill and seal packaging machine as set forth in claim 1 wherein each of said tube feeding belts has at least one longitudinally extending perforate portion, and wherein vacuum generating means is provided in communication with said perforate belt portions along their said inner runs to cause said belt runs to grip and to vacuum feed the tube of packaging material.

6. A vertical form, fill and seal packaging machine as set forth in claim 5 wherein a feed belt back-up means is disposed within the tube of packaging material in engagement with its internal surface and extending vertically opposite at least each inner feed belt run, and wherein each inner feed belt run is maintained in pressure engagement with the tube of packaging material with its pressure reacted by said back-up means to provide for frictional tube feeding action in addition to said vacuum tube feeding action.

7. A vertical form, fill and seal packaging machine as set forth in claim 1 wherein each of said side sealing and tube feeding back-up means is provided with a low friction surface for sliding engagement with said tube of packaging material, and wherein each of said tube feeding belts and said side sealing belt are provided with a high friction surface for gripping engagement with said tube of packaging material.

8. A vertical form, fill and seal packaging machine as set forth in claim 7 wherein each of said feed belt and side sealing back-up means has a fluorocarbon polymer surface, and wherein each of said tube feeding and sealing belts has a rubber-like tube engaging surface.

9. A vertical form, fill and seal packaging machine as set forth in claim 1 wherein said support means further comprises a housing for said side sealing means and means connecting said housing with said opposite end porton of said pivot member, said pivot member also being adjustable relative to said connecting means.

10. A vertical form, fill and seal packaging machine as set forth in claim 9 wherein a spaced pair of pivot members are provided each with one end portion adjustable about an axis coincident with said driven roll axis, and wherein said connecting means comprises a mounting rod for said sealing means housing, opposite end portions of said mounting rod being adjustably connected respectively with said opposite end portions of said pivot members.

11. A vertical form, fill and seal packaging machine as set forth in claim 1 wherein means is provided for selectively moving said support means for said side sealing means bodily toward and away from said tube of packaging material for withdrawal of the sealing means preventing overheating of said longitudinal edge portions of the tube.

12. A vertical form, fill and seal packaging machine as set forth in claim 11 wherein said means for selectively moving said support means comprises a movable power transmitting train connected between said driven sealing belt roll and said drive means, and a fluid cylinder operable to move said power transmitting train bodily in one and opposite directions respectively to withdraw said sealing means as aforesaid and to return said sealing means to an operative position.

13. A vertical form, fill and seal packaging machine as set forth in claim 12 wherein said power transmitting train comprises a plurality of drive gears for said driven roll of said sealing means and a mounting means for said drive gears, said mounting means being adapted for swinging movement about an axis coincident with one of said gears and being connected with a fluid cylinder for movement in one and an opposite arcuate directions thereby.

14. A vertical form, fill and seal packaging machine as set forth in claim 13 wherein said power transmitting train comprises three drivingly engageable gears with one of said gears connected with and driven by said drive means and in turn driving an intermediate one of said gears, the other of said gears connected with and driving said driven sealing roll, and said mounting means being swingable about said axis of said one gear connected with said drive means.

15. A vertical form, fill and seal packaging machine as set forth in claim 11 wherein said mounting means for said power transmitting train comprises a pair of interconnected spaced apart mounting plates swingable about said one gear axis at one end portion and adjustably carrying said support means for said sealing means at an opposite end portion.

16. A vertical form, fill and seal packaging machine as set forth in claim 1 wherein said electrical sealing belt heating means includes a heat block of good conductive material in engagement and in heat transfer relationship with said sealing belt and at least one electrical heating element operatively associated with said heat block.

17. A vertical form, fill and seal packaging machine comprising a source of flexible packaging material in the form of an elongated thin flat strip of material of uniform width comprising successive flat package blanks as integral longitudinally contiguous sections thereof, a tube former adapted to receive said strip material and to progressively form the same to a depending and upwardly open tubular configuration, opposite longitudinal edge portions of the material being progressively juxtaposed by said former so as to extend vertically in parallel relationship for side sealing, product dispensing means above said former and operable for the gravity discharge of measured quantities of product to the interior of the tube of packaging material through its said upwardly open end, end sealing means operable to provide successive longitudinally spaced horizontal end seals across the tube, first and second pairs of vertically spaced rolls respectively on opposite external sides of said tube of packaging material beneath said tube former, first and second endless tube feeding belts respectively trained over said first and second pairs of rolls, each belt having a vertically extending inner run engageable with the external surface of the tube of packaging material, means for driving at least one roll in each of said first and second pairs of rolls to cause said inner belt runs to travel downwardly in unison and thereby to effect tube feeding action drawing the tube of material downwardly through the former and successively presenting said integral packaging blanks therebeneath for filling, sealing and package formation, and side sealing means for engaging and sealing together said juxtaposed vertically extending longitudinal edge portions of said depending tube of packaging material, said means comprising a third pair of rolls spaced vertically along the path of tube movement adjacent the tube longitudinal edge portions, a third endless belt trained thereover and having an inner run in external pressure engagement with the longitudinal tube edge portions and movable downwardly therewith during said tube feeding action, vertically extending sealing backup means disposed within the tube of packaging material adjacent said longitudinal edge portions and internally engaging the same to react the pressure of said inner run of said sealing belt, and electrical sealing belt heating means engageable with the belt and operable to heat the same whereby to heat seal said longitudinal edge portions together in downward movement of the tube of packaging material past the side sealing means, said heating means including a heat block with a heat transfer surface in engagement with an outer run of said sealing belt and a heat bar disposed between and in engagement with said inner and outer belt runs.

18. A vertical form, fill and seal packaging machine as set forth in claim 17 wherein said sealing means is provided with a support means connected with said heat bar, and wherein heat insulation means is provided between said support means and heat bar.

* * * * *